US007318332B1

(12) United States Patent
Miao

(10) Patent No.: US 7,318,332 B1
(45) Date of Patent: Jan. 15, 2008

(54) LOCK

(75) Inventor: Tony Miao, Taipei Hsien (TW)

(73) Assignee: Jin Tay Industries Co., Ltd., Taipei Hsien (TW)

( * ) Notice: Subject to any disclaimer, the term of this patent is extended or adjusted under 35 U.S.C. 154(b) by 0 days.

(21) Appl. No.: 11/498,733

(22) Filed: Aug. 4, 2006

(51) Int. Cl.
*E05B 27/00* (2006.01)

(52) U.S. Cl. ..... 70/493; 70/377; 70/492; 70/358

(58) Field of Classification Search ..... 70/492, 70/493, 358, 379 R, 376–378
See application file for complete search history.

(56) References Cited

U.S. PATENT DOCUMENTS

| | | | | | |
|---|---|---|---|---|---|
| 1,067,017 | A | * | 7/1913 | Frederiksen | 70/490 |
| 1,594,297 | A | * | 7/1926 | Muzzio | 70/365 |
| 1,932,706 | A | * | 10/1933 | Neer | 70/493 |
| 3,212,307 | A | * | 10/1965 | Hallgren | 70/492 |
| 3,877,268 | A | * | 4/1975 | Shull | 70/492 |
| 4,196,606 | A | * | 4/1980 | Guiraud | 70/491 |
| 4,890,467 | A | * | 1/1990 | Krause et al. | 70/369 |
| 4,941,336 | A | * | 7/1990 | Steckler | 70/365 |
| 4,953,420 | A | * | 9/1990 | Krubsack et al. | 70/366 |
| 5,189,895 | A | * | 3/1993 | Schwab et al. | 70/366 |
| 5,413,392 | A | * | 5/1995 | Schlack et al. | 292/204 |
| 5,479,800 | A | | 1/1996 | Myers | |
| 5,907,963 | A | * | 6/1999 | Myers et al. | 70/371 |
| 6,868,705 | B2 | * | 3/2005 | Miao | 70/492 |
| 7,146,833 | B2 | | 12/2006 | Ramsauer | |

FOREIGN PATENT DOCUMENTS

| | | | |
|---|---|---|---|
| DE | 20102793 | U1 | 8/2001 |
| DE | 20018281 | U1 | 4/2002 |
| DE | 20215619 | U1 | 4/2004 |
| DE | 202004001868 | U1 | 6/2004 |
| DE | 10329691 | A1 | 2/2005 |
| WO | WO-2004-035971 | A1 | 4/2004 |

* cited by examiner

*Primary Examiner*—Suzanne Dino Barrett
(74) *Attorney, Agent, or Firm*—Birch, Stewart, Kolasch & Birch, LLP

(57) ABSTRACT

A lock has a shell, an internal sleeve and a locking rod assembly. The shell has multiple protrusions formed inside the shell. The internal sleeve is mounted rotatably in the shell. The locking rod assembly is mounted in the internal sleeve and has multiple locking rods. Each locking rod has a cut selectively aligning with the protrusions in the shell. When the cuts of the locking rods align with the protrusions in the shell, the internal sleeve can be rotated relative to the shell to change the lock or unlock status of the lock.

6 Claims, 7 Drawing Sheets

LOCK

BACKGROUND OF THE INVENTION

1. Field of the Invention

The present invention relates to a lock, especially to a lock that latches or fastens an article at a certain position.

2. Description of the Prior Arts

Locks are usually used to latch or fasten an article at a certain position. Conventional small locks such as padlocks, ball locks, etc. have simple lock cylinders. The simple lock cylinder is easy to be broken. Therefore, the conventional small locks are unsafe.

To overcome the shortcomings, the present invention provides an improved lock to mitigate or obviate the aforementioned problems.

SUMMARY OF THE INVENTION

The main objective of the present invention is to provide a lock with a complicated lock cylinder. The lock has a shell, an internal sleeve and a locking rod assembly. The shell has multiple protrusions formed inside the shell. The internal sleeve is mounted rotatably in the shell. The locking rod assembly is mounted in the internal sleeve and has multiple locking rods. Each locking rod has a cut selectively aligning with the protrusions in the shell. When the cuts of the locking rods align with the protrusions in the shell, the internal sleeve can be rotated relative to the shell to change the lock or unlock status of the lock.

Other objectives, advantages and novel features of the invention will become more apparent from the following detailed description when taken in conjunction with the accompanying drawings.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 is a perspective view of a lock in accordance with the present invention; The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENTS

Figure 1:
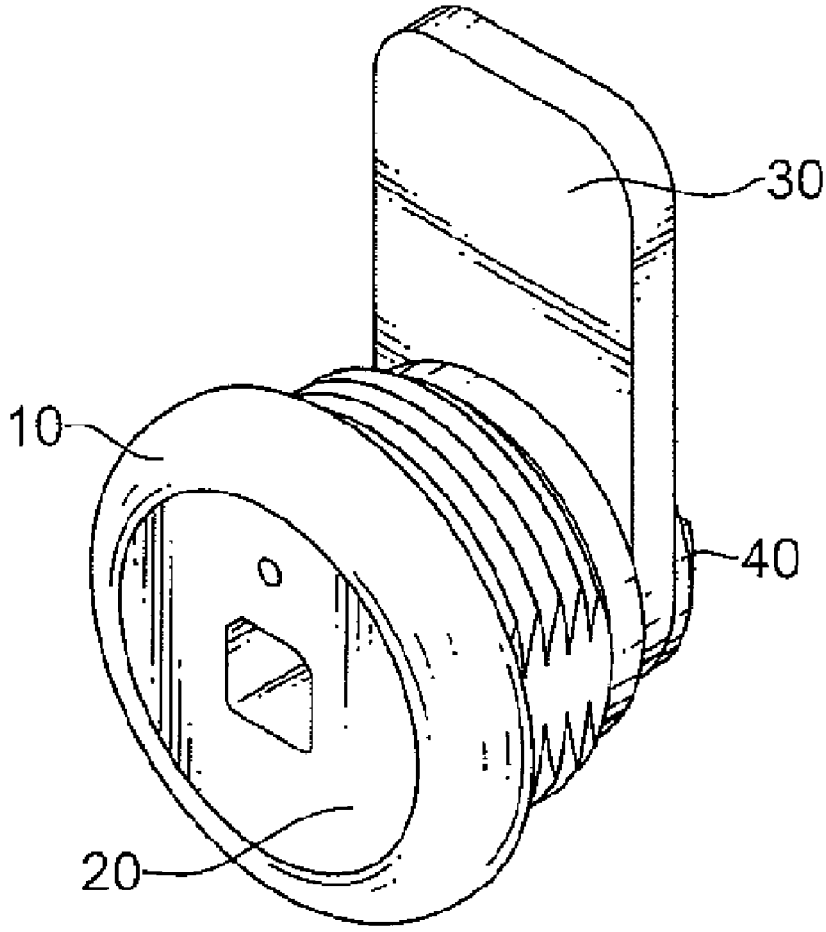
Figure 2:
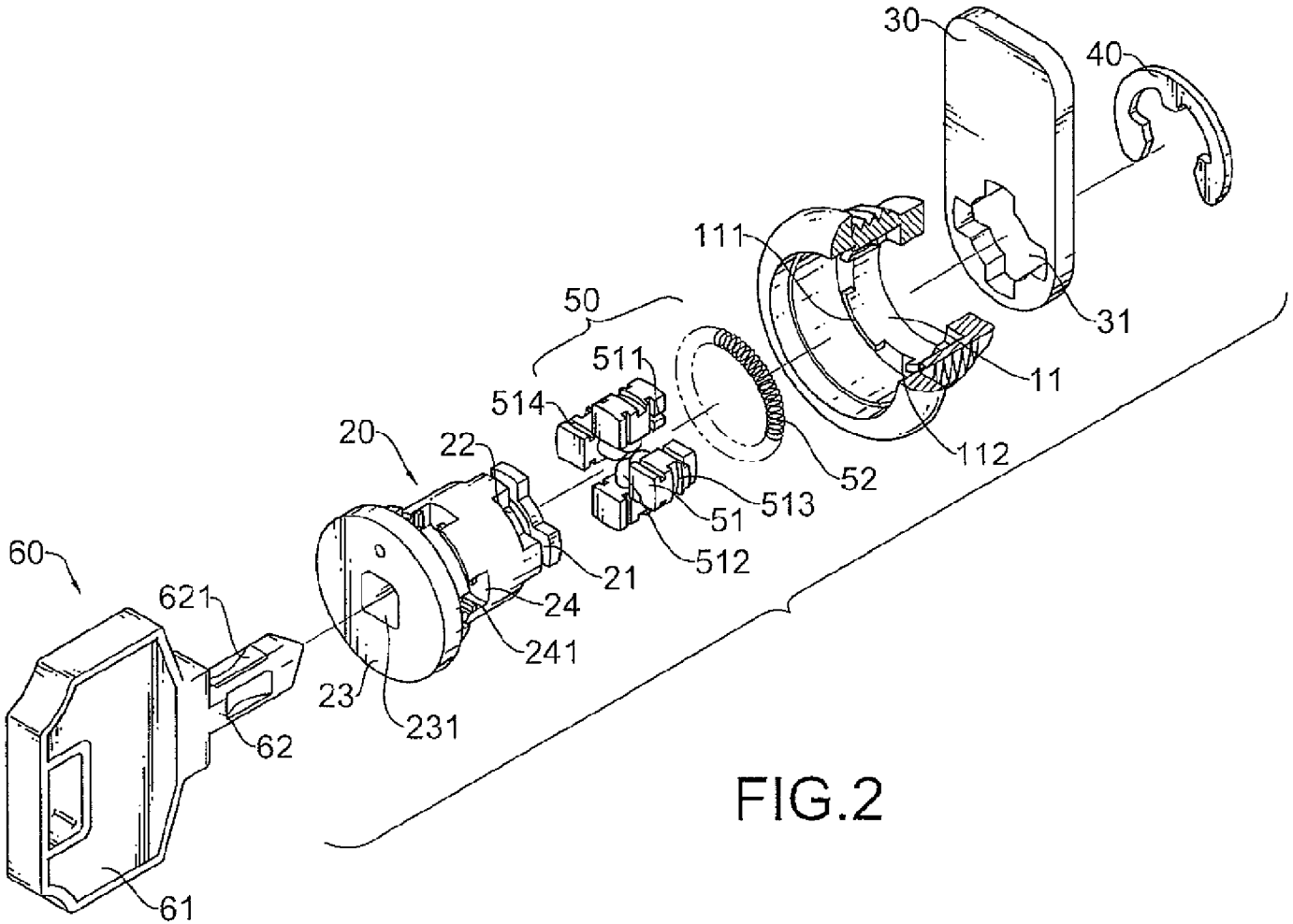
FIG. 2 is an exploded perspective view in partial section of the lock in FIG. 1 with a key.

With reference to FIGS. 1 and 2, a lock in accordance with the present invention comprises a shell (10), an internal sleeve (20), a tongue (30), a C-clip (40) and a locking rod assembly (50).

The shell (10) has a front opening end, a rear opening end, an internal wall and an annular protruding part (11). The annular protruding part (11) is formed on the internal wall of the shell (10) near the front opening end and has a front end, multiple protrusions (111) and multiple gaps (112). The protrusions (111) are formed separately on the front end of the annular protruding part (11) and may be separated from the internal wall of the shell (10). The gaps (112) are formed between the protrusions (111).

The internal sleeve (20) is mounted rotatably in the shell (10) and has a front end, a rear end, an internal wall, an external wall, an annular groove (21), multiple notches (22), a head (23), multiple through holes (24) and multiple ribs (241). The front and rear ends of the internal sleeve (24) respectively extend out of the shell (10). The annular groove (21) is formed in the external wall of the internal sleeve (20) near the front end. The notches (22) are formed separately in the external wall of the internal sleeve (20) and are formed in the front end of the internal sleeve (20). The head (23) is formed on the rear end of the internal sleeve (20) and has a central hole (231). The through holes (24) are formed separately through the external wall of the internal sleeve (20). The ribs (241) are formed respectively in the through holes (24) in the internal sleeve (20).

The tongue (30) is mounted securely on the front end of the internal sleeve (20) and has a fastening hole (31). The fastening hole (31) engages the notches (22) of the internal sleeve (20) to mount the tongue (30) securely on the internal sleeve (20). The tongue (30) is rotated by the internal sleeve (20) to change the status of the lock as described to be a lock status or an unlock status.

The C-clip (40) engages the annular groove (21) of the internal sleeve (20) to hold the internal sleeve (20) in the shell (10).

The locking rod assembly (50) is mounted in the internal sleeve (20) and comprises multiple locking rods (51) and a biasing ring (52). In the preferred embodiment, the locking rod assembly (50) has four locking rods (51). The locking rods (51) are respectively mounted slidably in the through holes (24) in the internal sleeve (20) and are mounted respectively in the gaps (112) of the shell (10). Each locking rod (51) has a front end, an outside surface, an inside surface, two lateral surfaces, a cut (511), a protruding rod (512), a mounting recess (513) and multiple slots (514). The cut (511) is formed in the front end of the locking rod (51) and selectively aligns with the protrusions (111) of the shell (10). The protruding rod (512) is formed on the inner surface of the locking rod (51). Distances of the protruding rods (512) to the outer surface of the locking rod (51) are different. The mounting recess (513) is formed in the outer surface of the locking rod (51). The slots (514) are formed in the lateral surfaces of the locking rod (51) and correspond to and are mounted slidably around the ribs (241) of the internal sleeve (20). The biasing ring (52) is mounted in the mounting recesses (513) of the locking rods (51).

Figure 3:
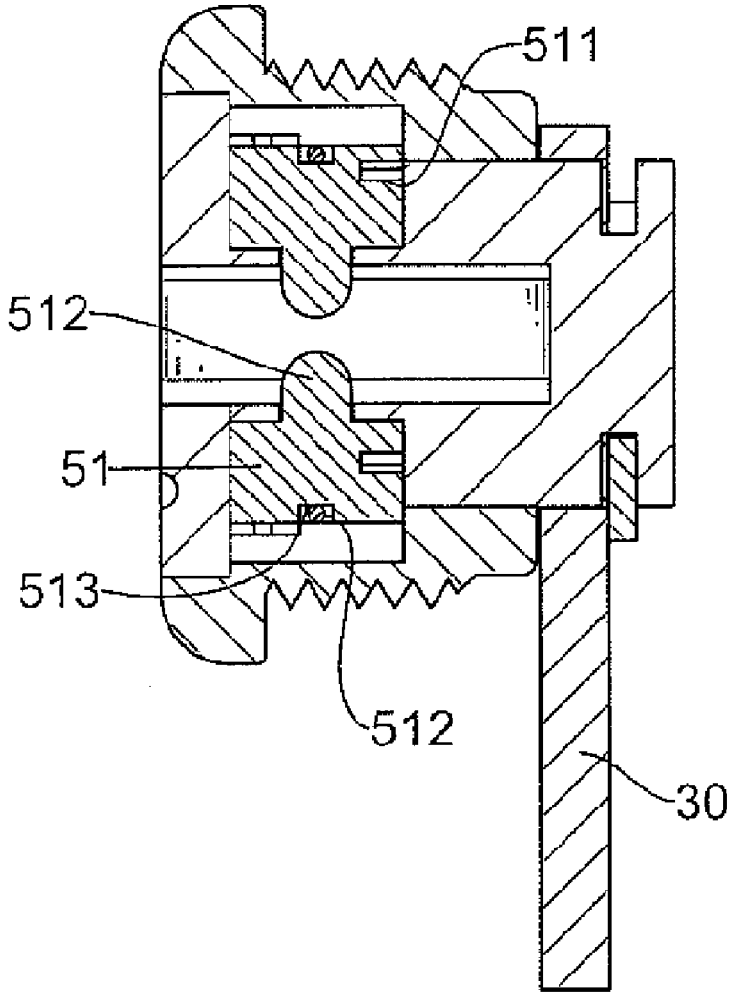
FIG. 3 is a cross-sectional side view of the lock in FIG. 1.
Figure 4:
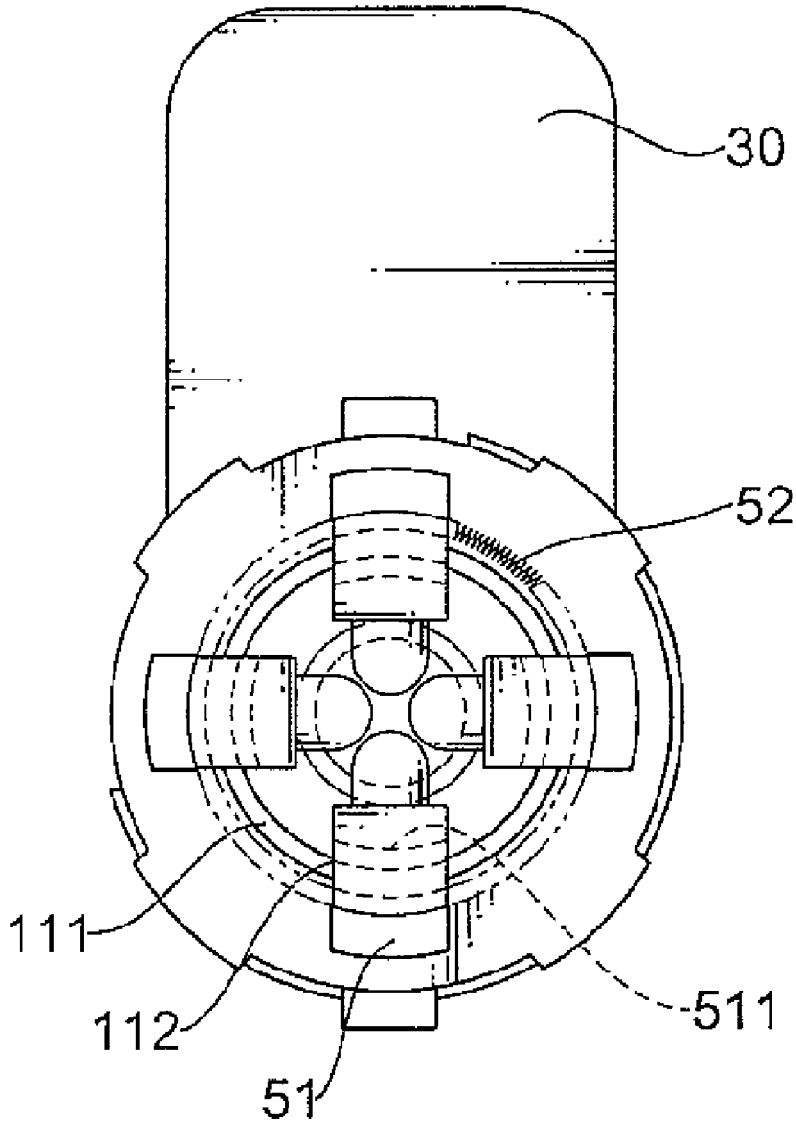
FIG. 4 is an end view of the lock in FIG. 1.

With further reference to FIGS. 3 and 4, the cuts (511) of the locking rods (51) does not align with the protrusions (111) of the shell (10). Because the lateral sides of the locking rods (51) abut the protrusions (111) of the shell (10), the protrusions of the shell (10) stop the internal sleeve (20)

from rotating relative to the shell (10) by abutting the locking rods (51). Then the tongue (30) also cannot be rotated relative to the shell (10). Thus, the lock or unlock status of the lock is unchangeable.

Figure 5:
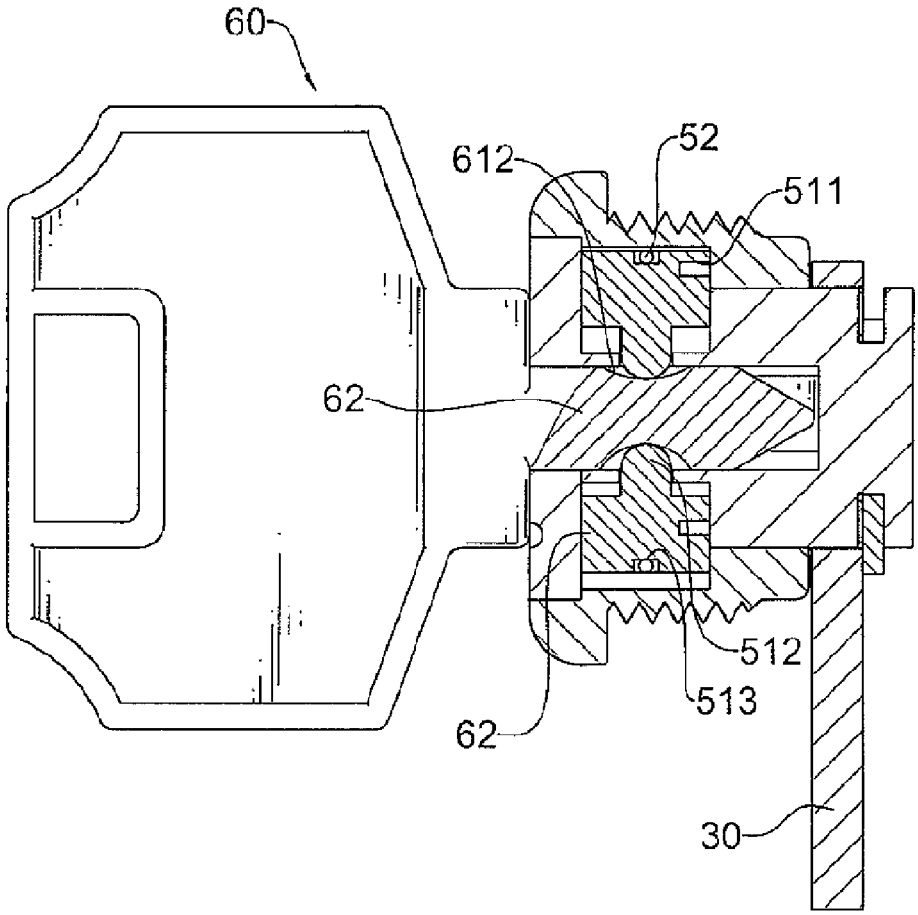
FIG. 5 is an operational side view in partial section of the lock in FIG. 1 with the key when the key is inserted into the lock.
Figure 6:
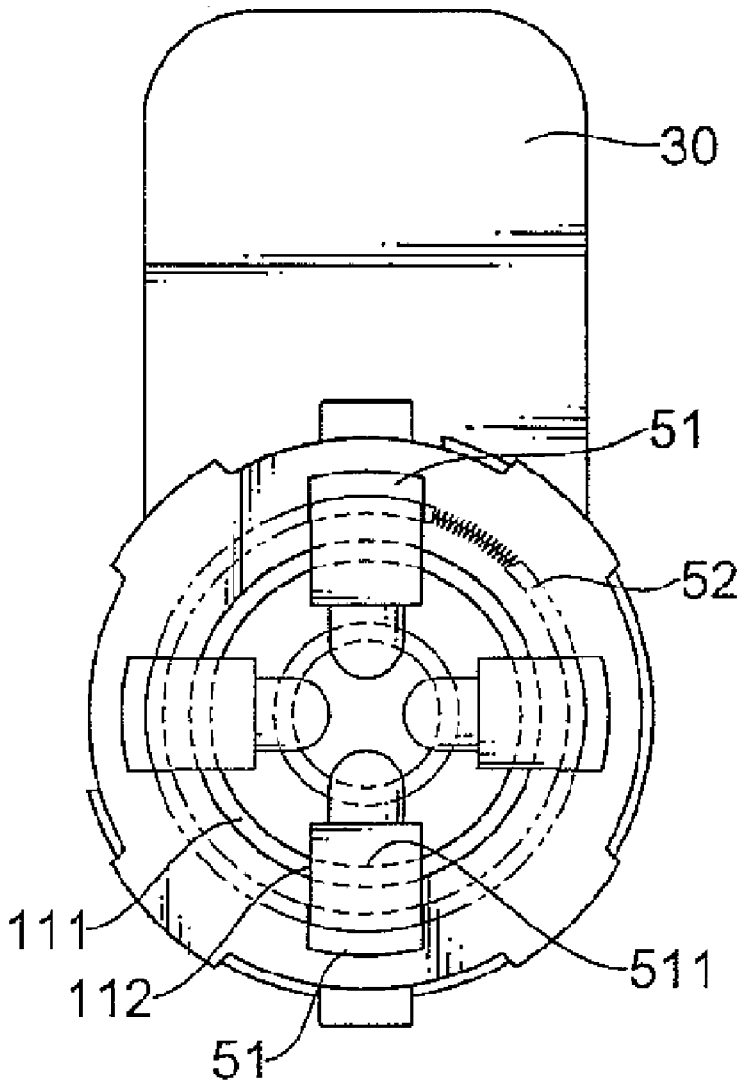
FIG. 6 is an operational end view of the lock in FIG. 1 when the key is inserted into the lock.

With further reference to FIGS. 5 and 6, a certain key (60) is inserted into the central hole (231) of the internal sleeve (20). The certain key (60) has a key stem (61) and a key blade (62). The key blade (62) has multiple recesses (621) formed in the key blade (62) to correspond to and to selectively engage the protruding rods (512) of the locking rods (51). When the certain key (60) is inserted into the central hole (231) of the internal sleeve (20), the recesses (621) of the key (60) engages the protruding rods (512) of the locking rods (51) to push the locking rods (51). Therefore, the cuts (511) of the locking rods (51) align with the protrusions (111) of the shell (10). The cuts (511) of the locking rods (51) slide around the protrusions (111) of the shell (10) to allow the internal sleeve (20) rotating relative to the shell (10). Then the tongue (30) can also be rotated relative to the shell (10). Thus, the lock or unlock status of the lock is changeable.

Figure 7:
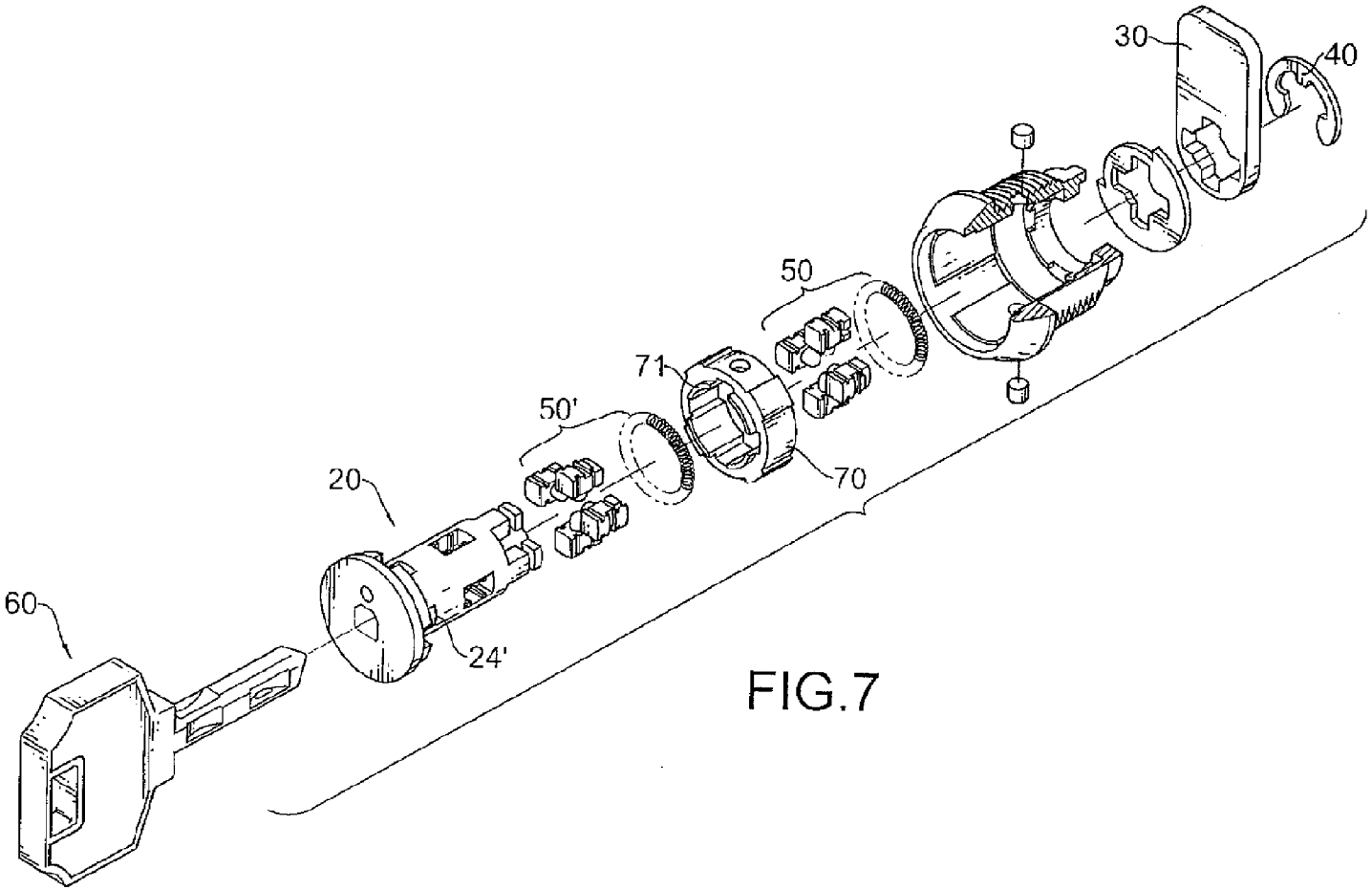
FIG. 7 is an exploded perspective view in partial section of another embodiment of a lock in accordance with the present invention with the key.

With further reference to FIG. 7, the lock further comprises an additional ring (70) and two locking rod assemblies (50, 50'). The additional ring (70) is mounted securely in the shell (10) and has multiple protrusions (71) corresponding to the protrusions (111) of the shell (10). The locking rod assemblies (50, 50') are mounted in the through holes (24, 24') of the internal sleeve (20). One of the locking rod assemblies (50, 50') corresponds to the annular protruding part (11) of the shell (10) and the other one of the locking rod assemblies (50, 50'), corresponds to the additional ring (70). With two locking rod assemblies (50, 50'), the lock of the present invention is more complicated.

The advantage of the present invention is to use at least one locking rod assembly (50) to increase the complex of the present invention. Therefore, the present invention is not easy to be broken and is safer.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lock comprising:

a shell, an internal sleeve mounted rotatably in the shell, a tongue mounted securely on the front end of the internal sleeve, and at least one locking rod assembly mounted in the internal sleeve;

wherein the shell has an internal wall and an annular protruding part formed on the internal wall of the shell, and the annular protruding part has a front end with multiple protrusions formed separately thereon, and multiple gaps formed between the protrusions, the protrusions of the shell being separated from the internal wall of the shell;

wherein the internal sleeve has a front end extending out of the shell and a rear end with a central hole formed therethrough;

wherein each one of the at least one locking rod assemblies has multiple locking rods respectively and slidably mounted in the internal sleeve, multiple locking rods respectively mounted in the gaps of the shell, and a biasing ring mounted around the outside surfaces of the locking rods; and wherein each of the at least one locking rods has a front end, an outside surface, an inside surface, a cut formed in the front end of the locking rod and selectively aligning with the protrusions of the shell, and a protruding rod formed on the inner surface of the locking rod.

2. The lock as claimed in claim 1, wherein the internal sleeve has an external wall with multiple through holes formed separately therethrough and the locking rods are respectively and slidably mounted in the through holes of the internal sleeve.

3. The lock as claimed in claim 2, wherein the shell has a front end, the internal sleeve has an annular groove formed in the external wall thereof near the front ends, and the lock further comprises a C-clip engaging the annular groove of the internal sleeve.

4. The lock as claimed in claim 3, wherein the internal sleeve has multiple ribs formed respectively therethrough, and each locking rod has two lateral surfaces with multiple slots formed therein, the multiple slots corresponding to and being mounted slidably around the ribs of the internal sleeve.

5. The lock as claimed in claim 4 wherein the internal sleeve has multiple notches formed separately in the external wall thereof and formed in the front end of the internal sleeve, and a head is formed on the rear end of the internal sleeve, the central hole of the internal sleeve being formed through the head of the internal sleeve, and the tongue having a fastening hole engaging the notches of the internal sleeve.

6. The lock as claimed in claim 1, wherein the internal sleeve has an external wall with multiple through holes formed separately therethrough, and the lock further comprises:

an additional ring mounted securely in the shell and having multiple protrusions corresponding to the protrusions of the shell; and two locking rod assemblies mounted in the through holes of the internal sleeve, wherein one of the locking rod assemblies corresponds to the annular protruding part of the shell and the other one of the locking rod assemblies correspond to the additional ring.

* * * * *